United States Patent [19]

Boyd et al.

[11] Patent Number: 4,472,598

[45] Date of Patent: Sep. 18, 1984

[54] BRAIDLESS PERFORATED CABLE

[75] Inventors: Clinton A. Boyd; Raymond L. Guzy, both of Tulsa, Okla.

[73] Assignee: Hughes Tool Company, Houston, Tex.

[21] Appl. No.: 488,954

[22] Filed: Apr. 27, 1983

[51] Int. Cl.[3] ..... H01B 3/28; H01B 9/06

[52] U.S. Cl. ..... 174/113 R; 174/102 SP; 174/117 F; 264/174

[58] Field of Search ..... 174/113 R, 117 F, 102 SP; 264/174

[56] References Cited

U.S. PATENT DOCUMENTS

| | | | |
|---|---|---|---|
| 3,485,939 | 12/1969 | Brown et al. | 174/113 R |
| 3,710,009 | 1/1973 | Hoeg et al. | 174/113 R X |
| 3,832,481 | 8/1974 | Boyd et al. | 174/102 R |
| 3,889,049 | 6/1975 | Legg et al. | 174/113 R X |
| 4,088,830 | 5/1978 | Wargin et al. | 174/113 R |
| 4,091,064 | 5/1978 | Kakinuma et al. | 264/174 |
| 4,096,351 | 6/1978 | Wargin et al. | 174/102 R |
| 4,140,114 | 2/1979 | Moore et al. | 174/47 X |

FOREIGN PATENT DOCUMENTS

| | | | |
|---|---|---|---|
| 938665 | 10/1948 | France | 174/113 R |
| 161534 | 12/1957 | Sweden | 174/113 R |
| 821281 | 10/1959 | United Kingdom | 174/113 R |

*Primary Examiner*—John Gonzales
*Assistant Examiner*—Morris H. Nimmo
*Attorney, Agent, or Firm*—Robert A. Felsman; James E. Bradley

[57] ABSTRACT

An electrical cable has features that allow its use in wells containing oil, water and gas, for use with submersible pumps. The cable has a number of conductors. Each conductor is surrounded by an insulating layer of oil and brine resistant thermosetting material. The insulating layer is permeable to gas. A polymeric jacket is extruded around all of the conductors, separating the conductors from each other and in direct physical contact with the insulating layers. Perforations are placed in the jacket at regular intervals. During rapid depressurization, gas absorbed in the insulating layers is able to flow freely from the cable by means of the perforations in the jacket. The jacket has sufficient strength to prevent rupturing of the insulating layers during depressurization.

2 Claims, 3 Drawing Figures

BRAIDLESS PERFORATED CABLE

BACKGROUND OF THE INVENTION

1. Field of the Invention

This invention relates in general to electrical cable, and in particular to an electrical cable for use with submersible pumps.

2. Description of the Prior Art

This invention concerns an electrical power cable used to power a downhole electrical motor for a submersible pump. These submersible pumps normally pump a mixture of oil and brine from wells often several thousand feet deep and often under high temperatures. The electrical cable normally consists of three stranded conductors. Each stranded conductor contains an insulating layer of a material that is resistant to oil and brine. Typically, an elastomeric jacket is extruded over the three conductors and an outer metallic armor surrounds the jacket.

In wells that have a significant gas content, gas permeation of the jacket occurs by way of absorption or defects. Periodically, all submersible pumps must be pulled to the surface for servicing. As the pump is pulled to the surface, the pressure and temperature both rapidly decrease. If gas has permeated the jacket, the reduction in temperature and pressure traps low molecular weight gasses in the cable. The basically, non-porous impermeable jacket does not allow the gas to escape rapidly. The gas within expands under reduced pressure, causing the jacket to balloon, and rupture.

An improved structure is disclosed in U.S. Pat. Nos. 4,088,830, issued May 9,1978 and U.S. Pat. No. 4,096,351, issued June 20, 1978, the inventors of both of which are Robert V. Wargin an Clinton A. Boyd. These patents teach the use of an insulating layer of thermosetting material that is resistant to oil and brine, but does allow some absorption of gas. The insulating material is relatively thin and allows gas to rapidly desorb when the cable is being pulled to the surface. A fiber braid surrounds each conductor, and contains the porous insulation layer to prevent rupturing of the insulation layer during depressurization. In the '351 patent, the conductors are surrounded by metallic armor, and in the '830 patent, the conductors are surrounded by a polypropolene, perforated layer, which serves as the armor. While the cables of these two patents perform successfully, the braid surrounding each conductor individually adds considerably to the cost of the cable.

SUMMARY OF THE INVENTION

A cable is provided in this invention that is braidless, yet prevents ballooning due to gas being absorbed. This cable has an insulating layer of oil and brine resistant material surrounding each conductor. Rather than a braid, all of the insulated conductors are embedded within a polymeric jacket that has sufficient hoop strength to prevent ballooning of the insulating layers during depressurization. The polymeric jacket is extruded over all of the insulated conductors, surrounding and in direct intimate physical contact with each insulation layer. Regularly spaced perforations are placed in the jacket to make the jacket permeable to well fluid. The perforations extend from the surface of the jacket to the insulation layers to allow gas to freely escape during depressurization.

DESCRIPTION OF THE PREFERRED EMBODIMENT

Figure 1:
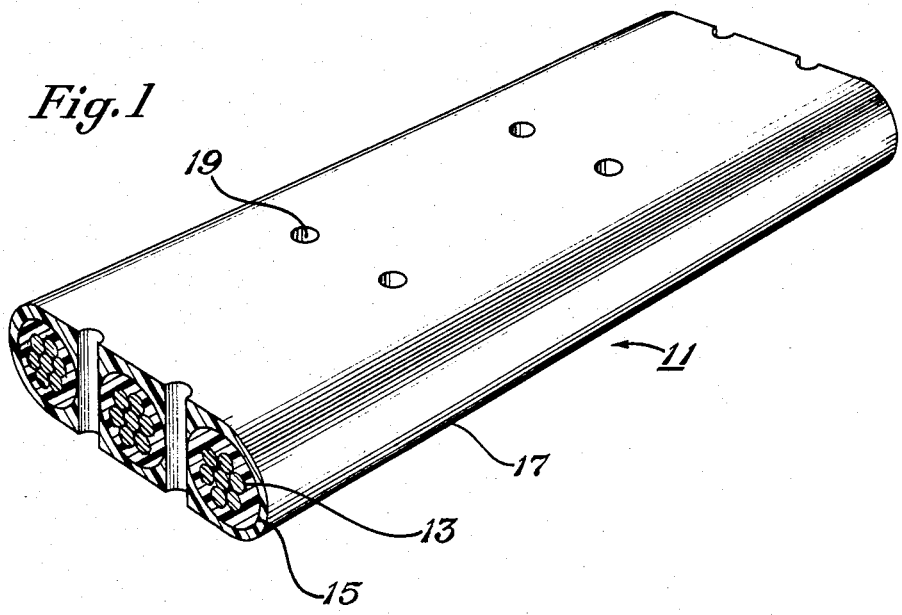
FIG. 1 is a perspective view of a cable constructed in accordance with this invention.
Figure 2:
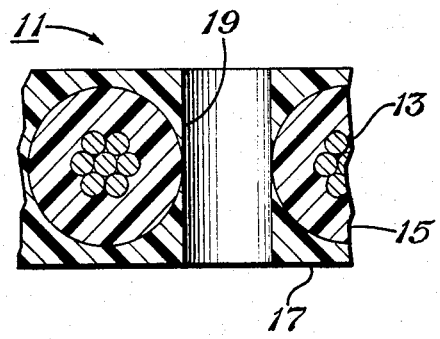
FIG. 2 is an enlarged sectional view of the cable of FIG. 1.

Referring to FIGS. 1 and 2, electrical cable 11 contains three metallic, electrical conductors 13. Each of the conductors 13 is stranded, containing seven, wound strands of wire. An insulating layer 15 is extruded over each of the conductors 13. The conductors 13 are located side-by-side in the same plane and spaced-apart from each other.

Insulating layer 15 is of a type that is disclosed in U.S. Pat. Nos. 4,096,351 and 4,088,830. It is oil and brine resistant and is permeable to low molecular gasses. Insulating layer 15 is relatively thin, having a thickness in the range from 0.020 to 0.150 inch, preferably between 0.070 and 0.110 inch, to allow the gas to rapidly desorb when the cable is being pulled to the surface. The physical and electrical properties of the insulation layer must remain essentially unaffected by the absorption of very low molecular weight hydrocarbons such as methane under high pressure.

One insulation material found to be satisfactory for this purpose is a modified EPDM (ethylene-propylene -diene monomer terpolymer) blend such as disclosed in U.S. Pat. No. 3,926,900. A blend represented by the following formulation may be employed as the insulation material in the practice of this invention:

| Material | Parts by Weight | Source |
|---|---|---|
| EPDM | 70 | B. F. Goodrich Co. |
| Oil | 35 | |
| Liquid Polybutadiene | 30 | Lithcoa |
| Zinc Oxide | 5 | |
| Stearic Acid | 1 | |
| Dihydroquinoline | 1 | |
| Titanium Dioxide | 10 | |
| Clay | 100 | |
| Trimethylopropane Trimethacrylate, Chemlink 30 | 2 | Ware Chemical Co. |
| Dicumyl Peroxide, Dicup 40KE | 11 | Hercules Chemical Co. |

This insulation material will be extruded onto the conductor 13 and cured in place to provide an insulation layer resistant to attack by water and well fluids. Depending upon the conductor material employed, further stabilization to heat and metals may be required and the use of stabilizers for this purpose is widely known in the insulation art.

A single jacket 17, surrounds all of the insulated conductors 13. Jacket 17 is in physical contact with and surrounds each insulation layer 15. Jacket 17 is about the same thickness as the insulating layers 15, and provides suitable hoop strength to prevent ruptures of the insulating layers 15. The material for jacket 17 can be any type of polymer, rubber or plastic, suitable for downhole applications. This material for jacket 17 should have good abrasion resistance to provide a tough outer cable surface. It should be resistant to attack or deterioration by chemical agents, including salts, acids, gases and hydrocarbons present within the well. Preferably the material of jacket 17 is an ethylene/acrylic elastomer having blended therewith a polybutadiene having greater than 50% 1,2 polymerized units and having a molecular weight between 1,500 and 25,000 grams/mole.

Preferably, the ethylene/acrylic elastomer is a terpolymer of ethylene, methyl acrylate, and a cure site monomer. The preferred ethylene/acrylic elastomer is a normally solid composition which is blended with a normally liquid polybutadiene, the polybutadiene having 65–95% 1,2 polymerized units and having a molecular weight between about 1,500 and 25,000 grams/mole. The preferred elastomeric composition of the invention has about 70 to 90% by weight of elastomeric composition of an ethylene/acrylic elastomer and 30 to 10 percent by weight of elastomeric composition of normally liquid polybutadiene blended with the ethylene/acrylic elastomer, the polybutadiene having at least 80% 1,2 polymerized units and having a molecular weight between about 1,500 and 25,000 grams/mole.

Jacket 17 has a plurality of perforations 19 spaced at regular, close intervals for allowing the free entry of well fluids to contact with the insulation layers 15. As shown in FIG. 2, the perforations 19 of the embodiment of FIG. 1 extend completely through the cable 11 between each conductor 13 from one flat surface to the opposite flat surface. Perforations 19 directly contact the insulation layers 15 to allow gas to desorb from the insulation layers 15 when the cable is being pulled to the surface. Preferably the perforations 19 are spaced about one inch apart.

In the preferred method of manufacturing the cable 11, the insulation layers 15 are first extruded onto the stranded conductors 13 in a conventional manner. Then, the jacket 17 is extruded over the insulated conductors 13, also in a conventional manner. Perforations 19 are formed in the surface at the time of extrusion, by various techniques, such as using hot needles. A metallic armor (not shown) could be placed over the jacket 17, if necessary because of possible damage that might occur because of certain well conditions and installation.

In the operation of the cable 11, it will be installed and used in a conventional manner. Well fluids will be allowed to come into contact with the insulating layers 15 by way of the perforations 19. Insulating layers 15 will admit a slight amount of gas, if such is present, which may enter the area between the strands of the conductors 13. Insulation layers 15, however, will prevent any liquids, such as brine or oil, from penetrating to the area of the conductors 13. When pulling to the surface, insulating layers 15 allow the gas to rapidly desorb and flow to the perforations 19 and to the surface. The surrounding material of the jacket 17 provides the necessary hoop strength to prevent rupturing of the insulating layers 15 as the cable 11 undergoes rapid depressurization.

Figure 3:
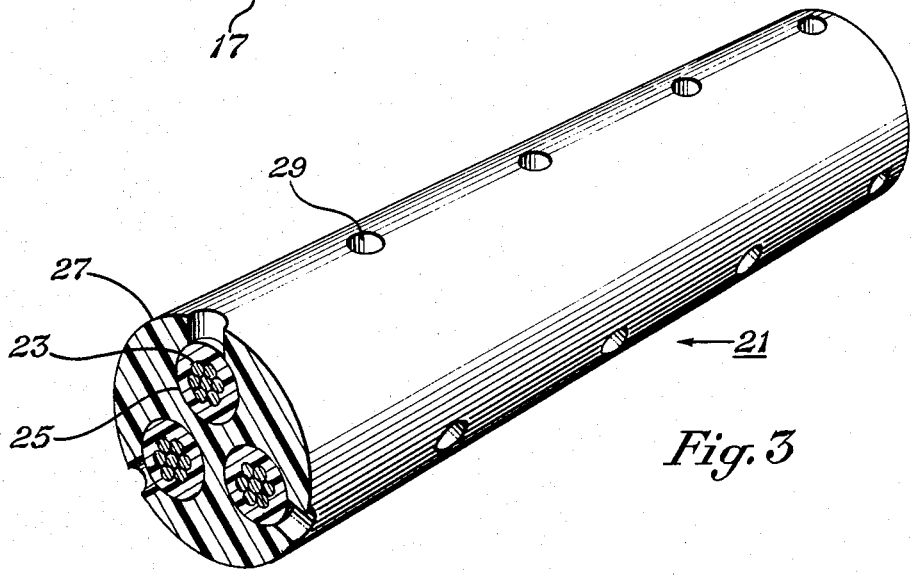
FIG. 3 is an alternate embodiment of a cable constructed in accordance with this invention.

The embodiment shown in FIG. 3 is constructed in the same manner as the embodiment of FIG. 1, however, it is in the form of a cylindrical or circular cross-section, rather than the flattened cross-section used in FIG. 1. Cable 21 has three conductors 23 radially spaced 120° apart about the axis of cable 21. Each conductor 23 has an insulating layer 25 identical to the insulating layer 15 of FIG. 1. A polymeric jacket 27 of material identical to the jacket 17 is extruded over and around each of the conductors 23 in direct physical contact with the insulating layers 25. Perforations 29 extend from the surface to each of the insulating layers 25. Perforations 29 can be spaced-apart 120°, and similar to perforations 19 of FIG. 1, allow absorbed gas to be rapidly desorbed from the insulating layers 25.

The invention has significant advantages. The use of a perforated jacket around a permeable thermoset insulation material allows the cable to be used in gassy, hot wells. Extruding the jacket material directly into contact with the insulation layer of each conductor provides the necessary hoop strength to prevent rupturing of the insulation layer during depressurization. This jacket avoids the need for a braid, thus reducing the cost of the cable.

While the invention has been shown in only two of its forms, it should be apparent to those skilled in the art that it is not so limited but is susceptible to various changes without departing from the scope of the invention.

I claim:

1. An electrical cable, comprising in combination:

a plurality of conductors;

an insulating layer surrounding each conductor, the insulating layer being permeable to gas and being resistant to oil and brine; and a single polymeric jacket which has been extruded over all of the insulating layers in substantially fully surrounding intimate contact with the insulating layers, a portion of the jacket being located between each of the conductors to provide hoop strength for the insulating layers to resist rupturing of the insulation layers upon lowering of the ambient pressure; and the jacket having perforations extending from its surface to the insulating layers for releasing absorbed gas.

2. A method of manufacturing an electrical cable for use with submersible pumps, comprising in combination:

extruding an insulating layer of oil and brine resistant thermosetting insulation material around a conductor; then extruding an elastomeric jacket around a plurality of the conductors in substantially fully surrounding intimate contact with the insulating layers of each conductor, each conductor being embedded in the jacket such that a portion of the jacket will be located between each of the conductors to provide hoop strength for the insulation layers to resist rupturing of the insulation layers upon lowering of the ambient pressure; then perforating the jacket with perforations extending from the insulating layers to the surface of the jacket.

* * * * *